US006021300A

United States Patent [19]

Jeong

[11] Patent Number: 6,021,300

[45] Date of Patent: Feb. 1, 2000

[54] ENGINE UNIT FOR IMAGE FORMING APPARATUS

[75] Inventor: Su-Jong Jeong, Kyongsangbuk-do, Rep. of Korea

[73] Assignee: SamSung Electronics Co., Ltd., Kyungki-do, Rep. of Korea

[21] Appl. No.: 09/249,481

[22] Filed: Feb. 12, 1999

[30] Foreign Application Priority Data

Aug. 14, 1998 [KR] Rep. of Korea ..... 98-33010

[51] Int. Cl.[7] ..... G03G 21/00

[52] U.S. Cl. ..... 399/296; 399/297

[58] Field of Search ..... 399/66, 111, 296, 399/128, 297, 310

[56] References Cited

U.S. PATENT DOCUMENTS 4,506,971 3/1985 Buell et al. .
4,538,901 9/1985 Soumiya .
4,978,998 12/1990 Aizawa .
5,038,177 8/1991 Parker et al. .
5,097,015 3/1992 Ream et al. ..... 399/66
5,581,329 12/1996 Kosmider et al. ..... 355/219
5,708,915 1/1998 Noguchi et al. ..... 399/49
5,727,248 3/1998 Ogura ..... 399/8
5,850,585 10/1997 Tsutsumi et al. ..... 399/128

*Primary Examiner*—Richard Moses
*Attorney, Agent, or Firm*—Robert E. Bushnell, Esq.

[57] ABSTRACT

An engine unit for an image forming apparatus transfers a toner image without corona discharge by adjusting a quantity of light radiated from pre-transfer lamps (PTLs). In the engine unit, a charge roller forms a uniform charge on an organic photoconductive (OPC) drum, and an exposure unit exposes the OPC drum to a light beam to form an electrostatic latent image. The PTLs apply a predetermined intensity of light to a non-image area on the OPC drum to change a potential of the non-image area to a value similar to a potential of an image area on the OPC drum, by adjusting a resistance value of resistors connected to the PTLs, so as to prevent a toner from remaining at a border between the image area and the non-image area. A transfer roller transfers the toner attached to the OPC drum to a recording sheet.

6 Claims, 3 Drawing Sheets

ENGINE UNIT FOR IMAGE FORMING APPARATUS

CLAIM OF PRIORITY

This application makes reference to, incorporates the same herein, and claims all benefits accruing under 35 U.S.C. §119 from an application for ENGINE UNIT FOR IMAGE FORMING APPARATUS earlier filed in the Korean Industrial Property Office on the 14th of Aug. 1998 and there duly assigned Serial No. 33010/1998.

BACKGROUND OF THE INVENTION

1. Field of the Invention

The present invention relates to an electrophotographic image forming apparatus, and in particular, to an engine unit capable of transferring a toner image to a recording sheet without corona discharge by adjusting a quantity of light radiated from pre-transfer lamps.

2. Description of the Related Art

An electrophotographic image forming apparatus includes an image forming unit for forming a toner image and a transfer unit for transferring the toner image to a recording sheet fed from a sheet feeding cassette in a main body of the apparatus. Specifically, the image forming unit includes an organic photoconductive (OPC) drum on which a toner image is formed, and the toner image formed on the OPC drum is transferred to the recording sheet by the transfer unit. The recording sheet with the transferred toner image passes through a fixing unit of the main body for fixing the toner image to the sheet, and then is discharged from the main body by a sheet discharging unit.

An earlier engine unit for an electrophotographic image forming apparatus has a developing unit mounted on a specified place in a main body of the image forming apparatus, and the developing unit has an OPC drum, a part of which protrudes out at the bottom of the developing unit. Further, in a sheet path, a transfer roller is mounted with an upper end thereof being protruded, so that the transfer roller comes in contact with the OPC drum, maintaining a constant pressure between the transfer roller and the OPC drum.

Further, a charge roller for uniformly charging a surface of the OPC drum with a high voltage and a developing roller for supplying a toner onto the OPC drum are rotatably fixed such that they come into contact with the OPC drum. A supply roller for supplying the toner provided from a toner container of the developing unit to the developing roller by contact charging is rotatably fixed such that it contacts with the developing roller. An exposure unit for forming an electrostatic latent image on the OPC drum is disposed at a specified place between the charge roller and the developing roller.

At the entrance to the transfer roller, a printed circuit board (PCB) including a plurality of, e.g., 16 pre-transfer lamps (PTLs) is mounted on a body frame under the sheet path. The PTLs are protected by a transparent plastic cover. Being placed in the sheet path, the cover guides a recording sheet being conveyed to the OPC drum side. Before the transfer roller transfers the toner image on the OPC drum to the recording sheet, the PTLs expose the OPC drum to decrease a surface potential of the OPC drum, thereby increasing a transfer efficiency of the transfer roller. Further, a corona discharge unit prevents a spreading phenomenon of the toner attached to the OPC drum, due to the decrease in the surface potential of the OPC drum by the PTLs.

In operation, the charge roller forms a uniform electric charge on the OPC drum. When the OPC drum is exposed to a light beam radiated from the exposure unit, an electrostatic latent image is formed on the OPC drum. Here, the OPC drum has a potential of −800V at a non-image area where the electrostatic latent image is not formed and a potential of −50V at an image area where the electrostatic latent image is formed. The developing roller, being provided with a developing voltage of −300V to −400V, rotates while keeping in contact with the OPC drum, to attach the toner supplied from the supply roller to the electrostatic latent image on the OPC drum. A surface potential of the developing roller provided with the developing voltage of −300V to −400V cancels the potential of −800V of the non-image area on the OPC drum with the passage of time, so that the potential on the non-image area of the OPC drum is in the range between −650V and −700V at that position of the drum's rotation. In this condition, when the recording sheet reaches the transfer roller, a transfer voltage of 1000V is provided to the transfer roller to transfer the toner attached to the OPC drum to the recording sheet. However, the toner may remain untransferred at the border between the image area and the non-image area on the OPC drum. To solve this problem, the PTLs radiate the light beam to the non-image area (having the potential of −650V to −700V) of the OPC drum. Then, the potential of the non-image area becomes similar to the potential of the image area, resulting in a spreading phenomenon of the toner. To prevent the spreading phenomenon of the toner, the corona discharge unit applies a potential of 4000V to the OPC drum. Here, for the corona discharge unit, the engine unit should have a power supply for generating a high voltage for the corona discharge, which increases the size and the cost of the apparatus.

Examples of engine units for image-forming apparatus of the conventional art are seen in the following U.S. Patents. U.S. Pat. No. 4,506,971, to Buell et al., entitled Transfer System, describes an electrophotographic system where the charged photoreceptor is exposed to light to substantially discharge the background around the image. This device employs a corona discharge unit, which as noted, increases the size and cost.

U.S. Pat. No. 4,538,901, to Soumiya, entitled Electrophotographic Copier With a Phantom Image Suppression Function, describes an electrophotographic device with a pre-transfer exposure lamp and a post-transfer exposure lamp, as well as a corona transfer unit and a corona separating device. In this device, the ratio of light from the two lamps is adjusted to be within a certain range.

U.S. Pat. No. 4,978,998, to Aizawa, entitled Image Transferring Device For Image Forming Equipment, describes an electrophotographic device with a pre-transfer lamp and a transfer charger, in which the pre-transfer lamp may be turned off during the trailing edge of the document, to avoid is loss of image in that portion of the printed document. This device also uses a transfer charger.

U.S. Pat. No. 5,038,177, to Parker et al., entitled Selective Pre-Transfer Corona Transfer With Light Treatment For Tri-Level Xerography, describes an electrophotographic device in which a pre-transfer charge corona is used in conjunction with a pre-transfer lamp.

Based on my observation of the art, then, I have found that what is needed is an image forming apparatus which does not employ a corona discharge unit, but which will prevent the spreading of toner due to the decreased surface potential of the OPC drum due to the pre-transfer lamps.

SUMMARY OF THE INVENTION

It is, therefore, an object of the present invention to provide an improved engine for an image forming apparatus.

It is also an object of the present invention to provide an engine for an image forming apparatus of greater simplicity than previous engines.

It is a further object of the invention to provide an image forming apparatus engine of reduced size.

It is a still further object of the invention to provide an image-forming apparatus engine of reduced cost.

To achieve the above objects, the present invention provides a compact, cheap engine unit for an image forming apparatus capable of transferring a toner image without corona discharge by adjusting a quantity of light radiated from pre-transfer lamps. There is provided an engine unit for an image forming apparatus including; an OPC drum; a charge roller for forming a uniform charge on the OPC drum; an exposure unit for exposing the OPC drum to a light beam to form an electrostatic latent image; a plurality of PTLs for applying a predetermined intensity of light to a non-image area on the OPC drum to change a potential of the non-image area to a value similar to a potential of an image area on the OPC drum by adjusting a resistance value of resistors connected to the PTLs, so as to prevent a toner from remaining at a border between the image area and the non-image area; and a transfer roller for transferring the toner attached to the OPC drum to a recording sheet.

The image area of the OPC drum, to which the toner is attached, has a potential of −50V, and the resistance value of the resistors is 620Ω. A surface potential at a specified point on the OPC drum is between −80V and 0V when the specified point are exposed to the light radiated from the PTLs. The surface potential of the specified point on the OPC drum is between −400V and −100V when the specified point meets the transfer roller. The surface potential at the specified point on the OPC drum is between −20V and +30V when the specified point passes the transfer roller.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE DRAWINGS

Figure 1:
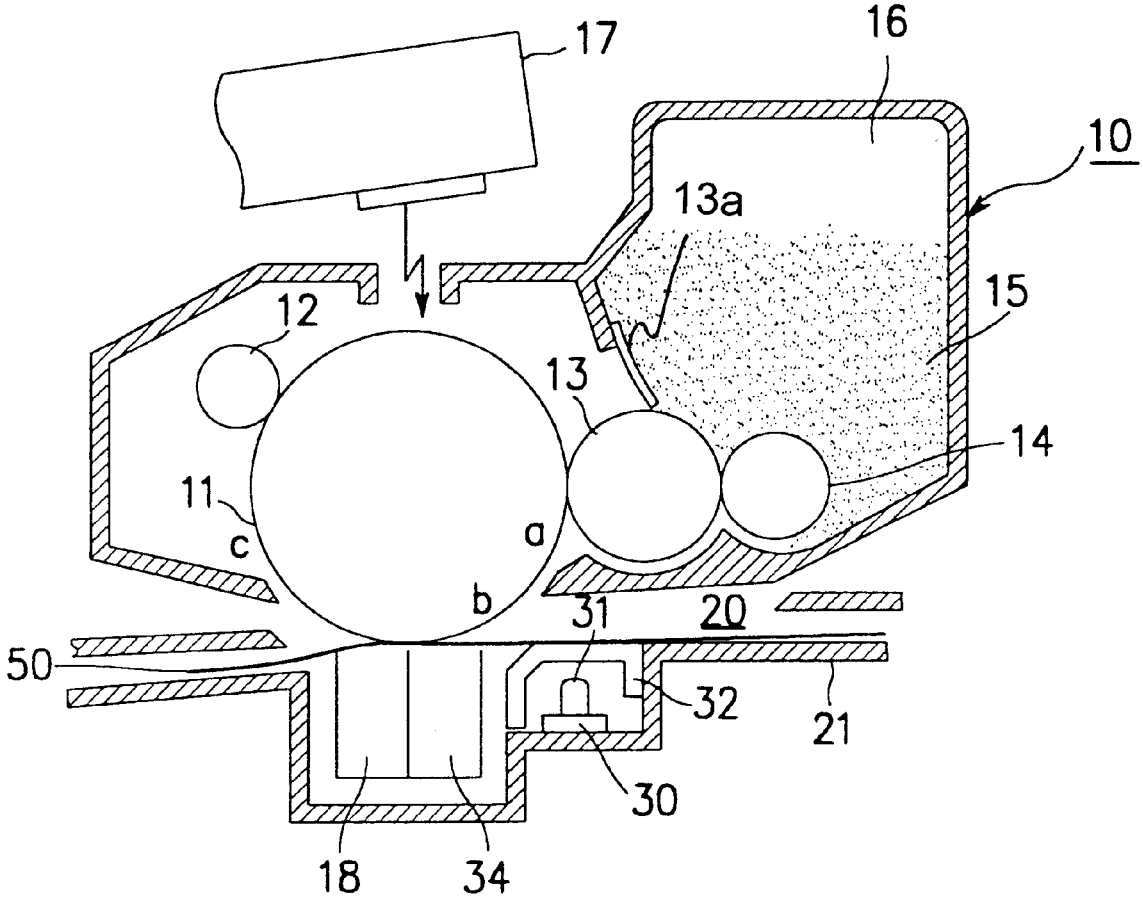
FIG. 1 is a diagram illustrating an earlier engine unit for an image forming apparatus.

Turning now to the drawings, FIG. 1 illustrates the earlier engine unit for an electrophotographic image forming apparatus discussed previously. Referring to FIG. 1, developing unit 10 is mounted at a specified place in a main body of the image forming apparatus, and the developing unit 10 has OPC drum 11, a part of which protrudes out of the bottom of developing unit 10. Further, in sheet path 20, transfer roller 18 is mounted with an upper end of the roller being protruded, so that transfer roller 18 comes in contact with OPC drum 11, maintaining a constant pressure between OPC drum 11 and transfer roller 18.

Further, charge roller 12 for uniformly charging a surface of OPC drum 11 with a high voltage and developing roller 13 for supplying a toner onto OPC drum 11 are rotatably fixed such that they come into contact with OPC drum 11. Supply roller 14 for supplying toner 15 provided from toner container 16 of developing unit 10 to developing roller 13 by contact charging is rotatably fixed such that it contacts developing roller 13. Exposure unit 17 for forming an electrostatic latent image on OPC drum 11 is disposed at a specified place between charge roller 12 and developing roller 13.

At the entrance to transfer roller 18, printed circuit board (PCB) 30 including a plurality of, e.g., 16 pre-transfer lamps (PTLs) 31 is mounted on body frame 21 under sheet path 20. PTLs 31 are protected by transparent plastic cover 32. Being placed in sheet path 20, cover 32 guides recording sheet 50 being conveyed to the OPC drum side. Before transfer roller 18 transfers the toner image on OPC drum 11 to recording sheet 50, PTLs 31 expose OPC drum 11 to decrease a surface potential of OPC drum 11, thereby increasing a transfer efficiency of transfer roller 18. Further, corona discharge unit 34 prevents a spreading phenomenon of the toner attached to OPC drum 11, due to the decrease in the surface potential of OPC drum 11 by PTLs 31.

In operation, charge roller 12 forms a uniform electric charge on OPC drum 11. When OPC drum 11 is exposed to a light beam radiated from exposure unit 17, an electrostatic latent image is formed on OPC drum 11. Here, OPC drum 11 has a potential of −800V at a non-image area where the electrostatic latent image is not formed and a potential of −50V at an image area where the electrostatic latent image is formed. Developing roller 13 being provided with a developing voltage of −300V to −400V rotates keeping in contact with OPC drum 11, to attach the toner supplied from supply roller 14 to the electrostatic latent image on OPC drum 11. A surface potential of developing roller 13 provided with the developing voltage of −300V to −400V cancels the potential of −800V of the non-image area on OPC drum 11 with the passage of time, so that the potential on the non-image area of OPC drum 11 is in the range between −650V and −700V at position "a". In this condition, when recording sheet 50 reaches transfer roller 18, a transfer voltage of 1000V is provided to transfer roller 18 to transfer the toner attached to OPC drum 11 to recording sheet 50. However, the toner may remain untransferred at the border between the image area and the non-image area on OPC drum 11. To solve this problem, PTLs 31 radiate light to the non-image area (having the potential of −650V to −700V) of OPC drum 11. Then, the potential of the non-image area becomes similar to the potential of the image area, resulting in the spreading phenomenon of the toner. To prevent the spreading phenomenon of the toner, corona discharge unit 34 applies a potential of 4000V to OPC drum 11. Here, for corona discharge unit 34, the engine unit requires a power supply for generating a high voltage for the corona discharge, which increases the size and the cost of the apparatus.

A preferred embodiment of the present invention will be described hereinbelow with reference to the accompanying drawings. In the following description, well known functions or constructions are not described in detail since they would obscure the invention in unnecessary detail.

Figure 2:
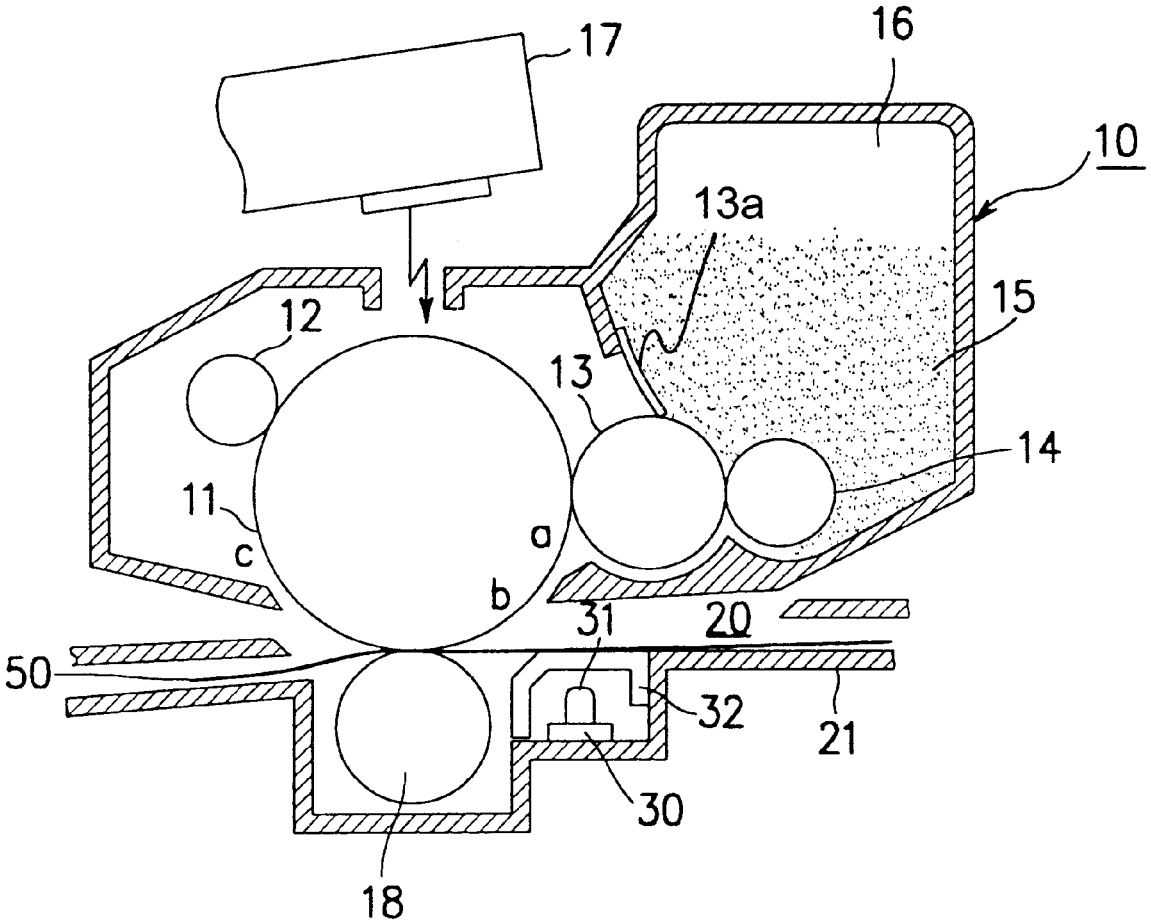
FIG. 2 is a diagram illustrating an engine unit for an image forming apparatus according to an embodiment of the present invention.

FIG. 2 illustrates an engine unit for an image forming apparatus according to an embodiment of the present invention. In FIG. 2, developing unit 10 is mounted at a specified place in a main body of the image forming apparatus. Developing unit 10 includes toner container 16 in which toner 15 is contained, and OPC drum 11 on which an electrostatic latent image is to be formed by exposure unit 17 mounted on the main body. At one side of OPC drum 11, charge roller 12 for charging the OPC drum surface with a high voltage is rotatably fixed keeping in contact with OPC drum 11. At another side of OPC drum 11, developing roller 13 for covering the electrostatic latent image with the toner is rotatably fixed keeping in contact with OPC drum 11. At one side of developing roller 13, supply roller 14 for supplying toner 15 contained in toner container 16 is rotatably fixed keeping in contact with developing roller 13. Further, over developing roller 13, regulation blade 13*a* for regulating a thickness of the toner attached to developing roller 13 is fixed to toner container 16. A lower part of OPC drum 11 installed in developing unit 10 protrudes out from the bottom of developing unit 10, so that OPC drum 11 rotates keeping in contact with transfer roller 18 mounted on body frame 21 under sheet path 20. Further, PTLs 31 are mounted on body frame 21 under sheet path 20.

Figure 3:
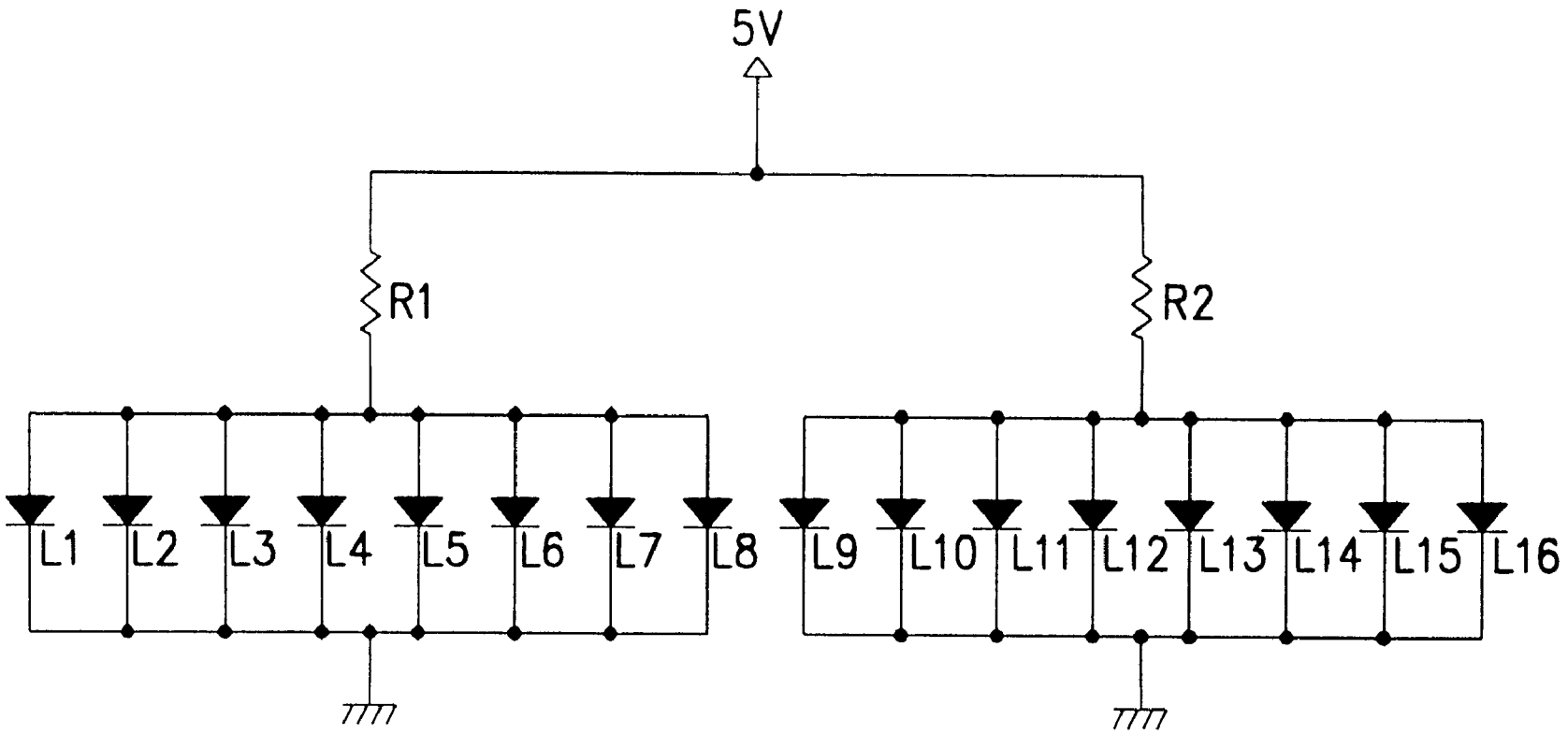
FIG. 3 is a detailed circuit diagram of pre-transfer lamps (31) of FIG. 2 according to an embodiment of the present invention.

FIG. 3 illustrates a detailed circuit diagram of PTLs 31 according to an embodiment of the present invention. As illustrated, 8 PTLs L1–L8 are connected to a power node (5V) via resistor R1, and 8 PTLs L9–L16 are connected to the power node via resistor R2. The intensity of the light radiated from the PTLs can be adjusted by changing the resistance of resistors R1 and R2.

Now, reference will be made to operation of the preferred embodiment of the present invention with reference to FIGS. 2 and 3. If OPC drum 11 rotates in contact with charge roller 12, charge roller 12 charges the surface of OPC drum 11 with the charge voltage $V_{CH}$ of a high voltage supplied thereto. For example, OPC drum 11 is charged with the charge voltage −800V. Thereafter, an electrostatic latent image is formed on OPC drum 11 by exposure unit 17. For example, an exposed area of OPC drum 11 on which the electrostatic latent image is formed has a potential of −50V, while a non-exposed area on which the electrostatic latent image is not formed has a potential of −800V. As OPC drum 11 rotates in contact with developing roller 13, the exposed area (i.e., the electrostatic latent image) on OPC drum 11 is covered with the toner. That is, since developing roller 13 is provided with a developing voltage $V_D$ of about −300V to −400V, the toner is firmly attached to the exposed area on OPC drum 11. Thereafter, the exposed area and non-exposed area on OPC drum 11 are both exposed to the light beam irradiated from PTLs 31, so that a potential of the non-exposed area is lowered near to −50V, for example, to a range of between approximately −80V and 0V. Here, the strength of the light beams irradiated from PTLs 31 is changed according to the resistance of resistors R1 and R2, and the potential of the non-exposed area is changed according to the strength of the light beam.

EXPERIMENT 1

A specified point on OPC drum 11, when it reaches position "a", has a potential in the range between −650V and −700V. In this condition, PTLs 31 radiate the light beam such that the specified point on OPC drum 11 has the potential of below, that is, more negative than, −80V when it reaches position "b". Then, the specified point on OPC drum 11 has the potential of below −400V when it meets transfer roller 18. Thereafter, when the specified point on OPC drum 11 reaches position "c", the potential of the specified point becomes below −20V. This potential of below −20V is added to the charge voltage $V_{CH}$ the point is again charged by charge roller 12, thus increasing the potential of the point at position "a". The increase of potential at the specified point causes a ghost noise.

EXPERIMENT 2

The specified point on OPC drum 11, when it reaches position "a", has a potential in the range between −650V and −700V. In this condition, PTLs 31 radiate the light beam such that the specified point on OPC drum 11 has the potential in the range between −80V and 0V when it reaches position "b". Then, the specified point on OPC drum 11 has the potential of between −400V and −100V when it meets the transfer roller 18. Thereafter, when the specified point on OPC drum 11 reaches position "c", the potential of the point is in the range between −20V and +30V, which is a range where the ghost noise does not occur and is thus permissible. Therefore, in this situation, the engine can transfer the toner image without the spreading phenomenon and the ghost noises. In this case, resistors R1 and R2 each had resistance of about 620Ω.

EXPERIMENT 3

The specified point on OPC drum 11, when it reaches position "a", has a potential in the range between −650V and −700V. In this condition, PTLs 31 radiate light such that the specified point on OPC drum 11 has the potential of over +0V when it reaches the position "b". Then, the specified point on OPC drum 11 has the potential of over, that is, more positive than, −100V when it meets the transfer roller 18. Thereafter, when the specified point on OPC drum 11 reaches position "c", the potential of the point is over +30V. This potential of over +30V is added to the charge voltage $V_{CH}$ when the point is again charged by the charge roller 12, thus decreasing the potential of the point at position "a". The decrease of potential at the specified point causes the spreading phenomenon as well as ghost noise.

The reason for lowering the surface potential of the non-exposed area on OPC drum 11 by using PTLs 31 is because the high energy is required and the transfer efficiency of transfer roller 18 is lowered, as the surface potential of the non-exposed area positioned at the border of the toner image is higher. Accordingly, by adjusting the intensity of the light radiated from PTLs 31, it is possible to reduce the potential of the exposed area on OPC drum 11 to below −50V and is also possible to reduce the potential of the non-exposed area near to −50V. Thereafter, the toner on OPC drum 11 is transferred to the recording sheet 50 passing through a gap between OPC drum 11 and transfer roller 18, by a transfer voltage $V_T$ (e.g., 1.0 kV) applied to transfer roller 18.

Therefore, by setting resistance values of resistors R1 and R2 such that OPC drum 11 has surface potential between −80V and −0V at position "b" and surface potential between −20V and +30 at position "c", it is possible to form a good image preventing the spreading phenomenon and the ghost noise, even without using the corona discharge unit. As stated above, the engine unit of the invention can prevent spread of the image and the ghost noises by adjusting the light intensity of the PTLs, and can increase the transfer efficiency even with a low transfer voltage. Further, since no corona discharge unit is used, the engine unit does not require the power supply for generating the high voltage, thereby contributing to a reduction in size of the image forming apparatus.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. An engine unit for an image-forming apparatus, comprising:

an organic photoconductive drum;

a charge roller for charging the OPC drum;

an exposure unit for exposing the OPC drum to a light beam to form an electrostatic latent image;

a plurality of pre-transfer lamps (PTLs) including a first set of lamps and a second set of lamps for applying light to the OPC drum to change the potential of a non-image area on the OPC drum;

a first resistor connecting the first set of lamps to a power node;

a second resistor connecting the second set of lamps to the power node; and a transfer roller for transferring toner from the OPC drum to a sheet.

2. The engine unit of claim 1, wherein said first and second resist are adjustable resistors.

3. The engine unit of claim 1, wherein the value of said resistors is such that, when the engine unit is operating, the surface potential of the OPC drum in the non-image area is in the range of approximately −80 V to 0 V after the non-image area is exposed to light from said PTLs.

4. The engine unit of claim 1, wherein the value of said resistors is such that, when the engine unit is operating, the surface potential of the OPC drum in the non-image area is in the range of approximately −400 V to −100 V when the non-image area meets the transfer roller.

5. The engine unit of claim 1, wherein the value of said resistors is such that, when the engine unit is operating, the surface potential of the OPC drum in the non-image area is in the range of approximately −20V to +30 V when the non-image area has passed the transfer roller.

6. The engine unit of claim 1, wherein each of said first and second sets of lamps comprises eight PTLs connected in parallel, and said resistors have a value of about 620Ω.

* * * * *